United States Patent [19]

Stoeckl et al.

[11] Patent Number: 5,015,035

[45] Date of Patent: May 14, 1991

[54] DENTAL PATIENT CHAIR

[75] Inventors: Klaus Stoeckl; Bernd Becker, both of Bensheim, Fed. Rep. of Germany

[73] Assignee: Siemens Aktiengesellschaft, Munich, Fed. Rep. of Germany

[21] Appl. No.: 450,618

[22] Filed: Dec. 14, 1989

[30] Foreign Application Priority Data

Dec. 14, 1988 [EP] European Pat. Off. ..... 88120938.1

[51] Int. Cl.[5] ..... A47C 1/02

[52] U.S. Cl. ..... 297/345; 297/330

[58] Field of Search ..... 297/330, 345, 316, 317, 297/321, 322, 327, 328, 329, 344, 346, 347; 248/241

[56] References Cited

U.S. PATENT DOCUMENTS

| | | | |
|---|---|---|---|
| 3,083,055 | 3/1963 | Davis | 297/345 |
| 3,302,971 | 2/1967 | Lory | 297/346 |
| 3,338,632 | 8/1967 | Kleinsorge | 297/330 |
| 4,173,372 | 11/1979 | Harris | 297/330 X |
| 4,312,500 | 1/1982 | Janssen | 269/324 |
| 4,344,594 | 8/1982 | Hirth | 297/330 X |
| 4,533,106 | 8/1985 | Stöckl | 248/421 |
| 4,722,566 | 2/1988 | Castellini | 297/330 X |

FOREIGN PATENT DOCUMENTS

| | | | |
|---|---|---|---|
| 0100490 | 12/1984 | European Pat. Off. . | |
| 2226572 | 12/1973 | Fed. Rep. of Germany . | |
| 2736276 | 11/1978 | Fed. Rep. of Germany | 297/330 |
| 2938330 | 4/1981 | Fed. Rep. of Germany . | |
| 2186218 | 1/1974 | France . | |
| 2450098 | 9/1980 | France . | |
| 2598911 | 11/1987 | France | 297/345 |

*Primary Examiner*—Laurie K. Cranmer

*Attorney, Agent, or Firm*—Hill, Van Santen, Steadman & Simpson

[57] ABSTRACT

A dental patient chair comprises an arrangement for adjusting the seat height, the inclination position of the seat and the backrest, as well as the position of the seat and backrest with reference to a longitudinal direction of the chair. The arrangement includes two pivotably connected arms having one arm pivotably connected to a pedestal and the other connected to the seat and being provided with a drive arrangement for shifting the arms relative to their pivotable connection to move the seat in both a vertical and horizontal direction, as well as to tilt the seat relative to a base plane. The arrangement includes a control device for operating the drive arrangement for pivoting the arms relative to the pivotable connections between themselves and to the pedestal and seat.

14 Claims, 6 Drawing Sheets

CONTROL MEANS
U
M1
M2
M3
G1
G2
G3
P1
P2
P3

DENTAL PATIENT CHAIR

BACKGROUND OF THE INVENTION

The present invention is directed to a dental patient chair comprising an arrangement for adjusting the seat height, the inclination position of the seat and backrest, as well as the position of the seat and backrest in a longitudinal direction relative to the base of the chair.

In order to be able to position a patient ergonomically and treatment-suited, i.e., optimally adjusted both with respect to the attendant as well as with respect to the treatment to be undertaken, it is necessary to be able to adjust both the seat and backrest, that form the upper chair part of a patient chair, both in height as well as in longitudinal direction of the chair and, over and above this, in its inclined position relative to a vertical or horizontal reference plane. Various designs are known for this purpose.

German OS 29 38 330 discloses a parallelogram linkage arrangement which is provided for the height adjustment of a seat. Although a relatively great stroke can be achieved with such a parallelogram linkage arrangement, it is necessarily a disadvantage that additional means must be provided in order to achieve initially addressed longitudinal adjustability of the upper chair part. German OS 22 26 572 discloses an arrangement for longitudinal adjusting, which can be a straight-line mechanism having a hooked-out curve for simultaneously lifting an end of the chair part adjacent the foot or foot end of the chair.

A scissor arm structure having mirror-inverted scissor arms arranged in pairs or having one set guided in corresponding longitudinal guide elements for longitudinal adjustment of an upper chair part are also known. An example is disclosed in U.S. Pat. No. 4,533,106, whose disclosure is incorporated by reference and which was based on German Application 32 28 834.

Although these latter scissor arm designs have proven themselves extremely well and have advantages over the earlier-known embodiments of being more space saving, relatively narrow limits are also nonetheless placed on these designs. For example, limits are placed on a design with respect to the demand for little mechanical outlay given an improvement in the motion possibilities, particularly relating to the height adjustment and longitudinal adjustability of the seat.

SUMMARY OF THE INVENTION

The objects of the present invention are to provide a dental patient chair having means for adjusting the seat height, the inclined position of the seat and backrest, as well as the position of the seat and backrest with reference to the longitudinal direction of the chair, and which means for adjusting can be produced with little mechanical outlay and also with less space required than previously needed. The present invention also takes into consideration that the initially-cited ergonomic and treatment-related points of view are taken into account in accordance with the versatile adjustment possibilities now required for the chair.

The significant advantage of the design of the invention is that a relatively simple design which, as seen in terms of the mechanism, does not require the longitudinal displacement elements for the adjustment of the upper chair part in accordance with the degree of freedoms that are provided. The mechanism provided, according to the present invention, is composed of practically only a stationary base part, two articulated arms, three drive motors, control means for the drive motors and a patient support that forms the upper chair part. The patient support can be fashioned as a single part or of a plurality of parts. Both electromotive as well as hydraulic drives can be utilized as the adjustable drive motors.

Other advantages and features of the invention will be readily apparent from the following description of the preferred embodiments, the drawings and claims.

DESCRIPTION OF THE PREFERRED EMBODIMENTS

Figures 1, 2:
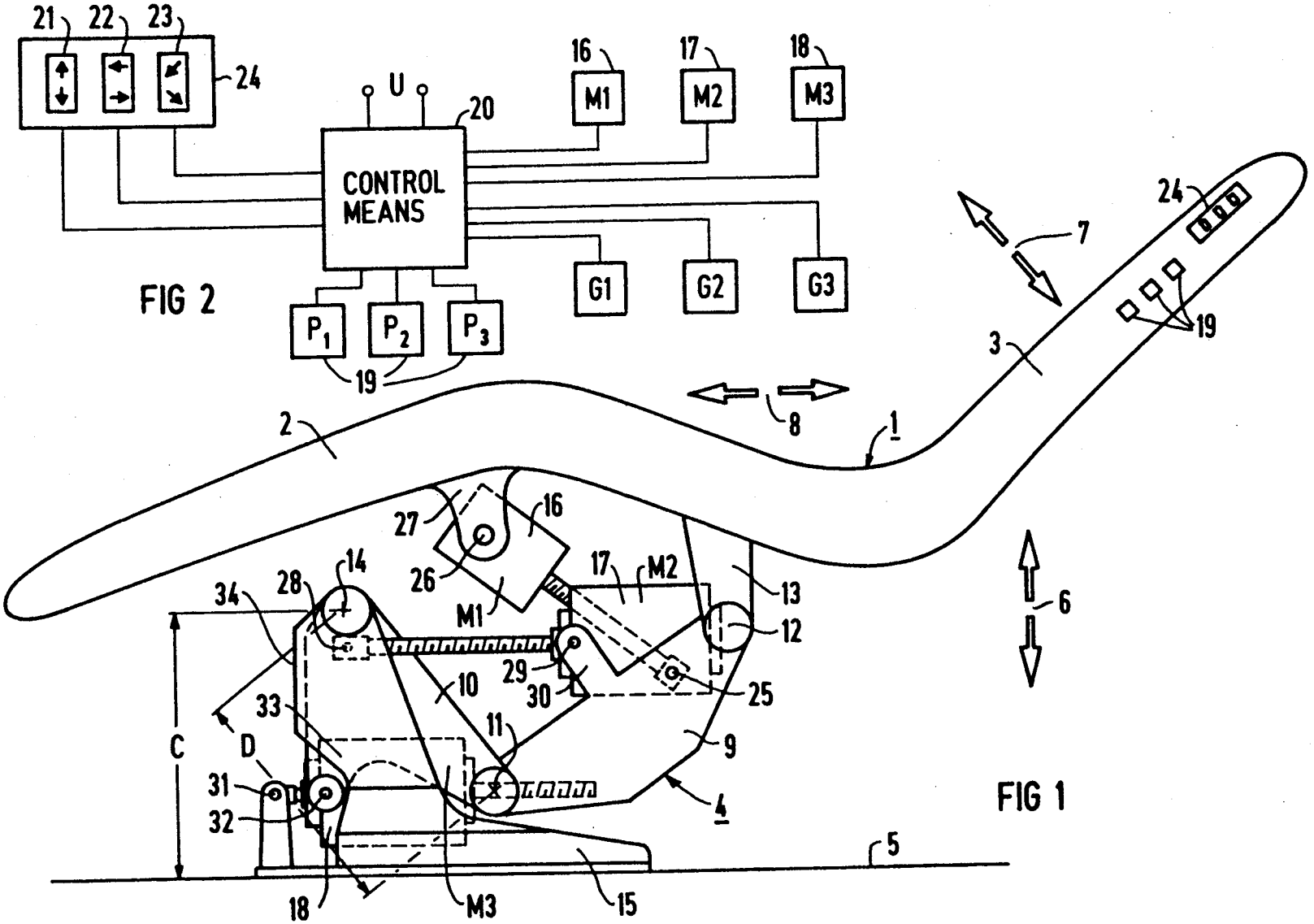
FIG. 1 is side view of a first embodiment of a dental patient chair in accordance with the present invention.
FIG. 2 is a schematic view of a control of the adjustable drive for the chair of FIG. 1.

The principles of the present invention are particularly useful when incorporated in a dental patient chair illustrated in FIG. 1. The dental patient chair of FIG. 1 has an upper chair part, generally indicated at 1, which is illustrated as a one-piece patient support that is composed of a seat 2 and a backrest 3 in a known way and is carried by an adjustment mechanism, generally indicated at 4, that is supported on a standard plane, which is illustrated as being formed by a floor 5. The adjustment mechanism 4 is of such a nature that a height adjustment of the chair part 1 can be made in the direction of a double arrow 6, an inclination of the backrest can be changed in accordance with a double arrow 7 and a longitudinal displacement of the entire upper chair part 1 relative to a fixed position or base can be made in the direction of a double arrow 8.

The adjustment mechanism 4 is composed of two articulately interconnected arms 9 and 10 which are pivotably connected to one another to rotate around a fixed axel at a point 11. The arm 9, at a free end, has a pivotable connection with a rigid part 13 of the upper chair part 1 to form an articulate joint to pivot around an axel or axis at the point 12. The arm 10, at its free end, is connected to a pedestal 34 of a base 15 to form a pivotable joint around an axis at the point 14. As illustrated, the base 15 has been stationarily placed on the standing plane formed by the floor 5.

The two articulated arms 9 and 10 can be adjusted with the assistance of the three adjustment means 16, 17 and 18, so that the upper chair part 1 can be moved in the direction of the arrows 6, 7 and 8. Advantageously, the adjustment means or drives 16, 17 and 18 are spindle drives whose motors M1, M2 and M3, as shown in simplified fashion in FIG. 2, are driven via a control means 20 that shall be set forth in greater detail later. In a known way, the drive can occur either in response to program selection keys 19 or in response to individual keys 21, 22 and 23 that, for example, are combined in a key field 24 arranged on the backrest 3 of the chair.

In the illustrated exemplary embodiment, the spindle drive 16 with the electric motor M1 is connected, first, to the articulated arm 9 by a pivotable connection 25 and to the carrier part 27, which is secured to the seat 2 by a pivotable connection or articulation 26. The adjustment motor M2 of the adjustment drive 17 is connected to the articulated arm 10 by a pivotable connection 28 and to an extension or continuation 30 of the articulated arm 9 by a pivotable connection 29. The adjustable drive 18, which includes the adjustment motor M3 is connected by a pivotable joint 31 to an elevated pedestal or part of the base 15 and is connected to a continuation or extension 33 of the arm 10 by a pivotable connection 32. Although this arrangement of the adjustable drive has proven advantageous, other arrangements are also conceivable within the framework of the present invention. For example the arrangement wherein the adjustable drive 17 does not extend between the articulated arms 9 and 10, but between the pedestal 34 and the articulated 9 or wherein the adjustable drive 16 does not extend between the seat and the arm 9 but between the seat and the pedestal 34 or between the seat and the articulated arm 10.

Figure 10:
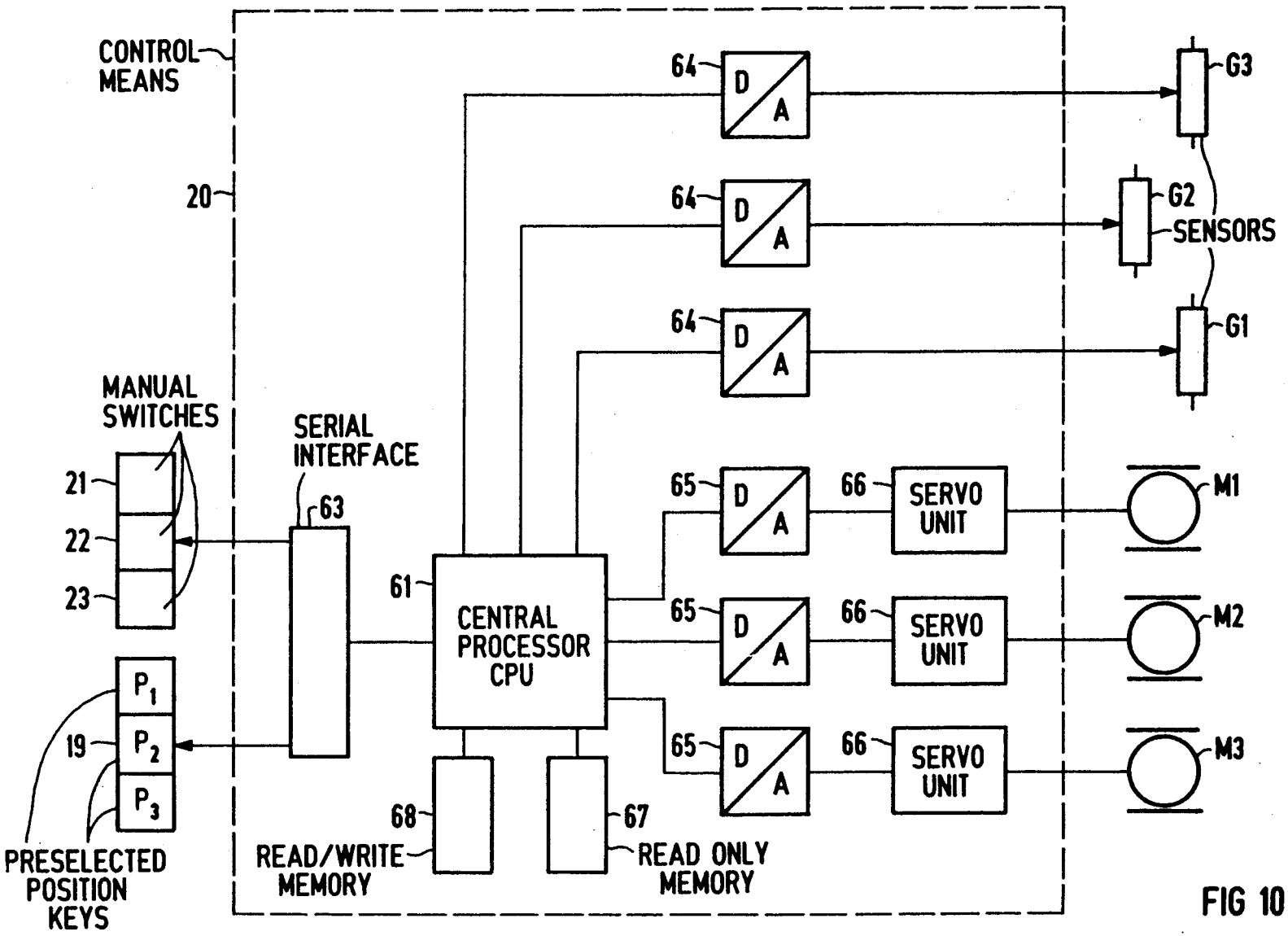
FIG. 10 is a block circuit diagram illustrating the control sequence for the present invention.

It is self-evident that the three adjustment motors M1, M2 and M3 in the illustrated design must be controlled simultaneously to obtain a smooth and harmonic motion of the patient chair in the direction of the three arrows 6, 7 and 8. When, for example, the upper chair part is only adjusted in height, for example only along the direction of the arrow 6, then it is not adequate to activate only one adjustment drive. On the contrary, all three adjustment motors must be driven in this case. The control occurs with the assistance of a control means 20, which is shown in FIGS. 2 and 10, and contains a microprocessor that receives information about the respective actual positions of the particular chair parts via position sensors G1, G2 and G3 and, subsequently, drives the adjustment motors M1, M2 and M3 in accordance with the desired adjustment. The sensors G1–G3 provide the control means with the respective position of the particular articulated arm or, respectively, chair part and the sensors can be of an electrical, optical or opto-electric type and can be arranged either at the drives themselves or at the points of articulation of the articulated arms.

Figure 7:
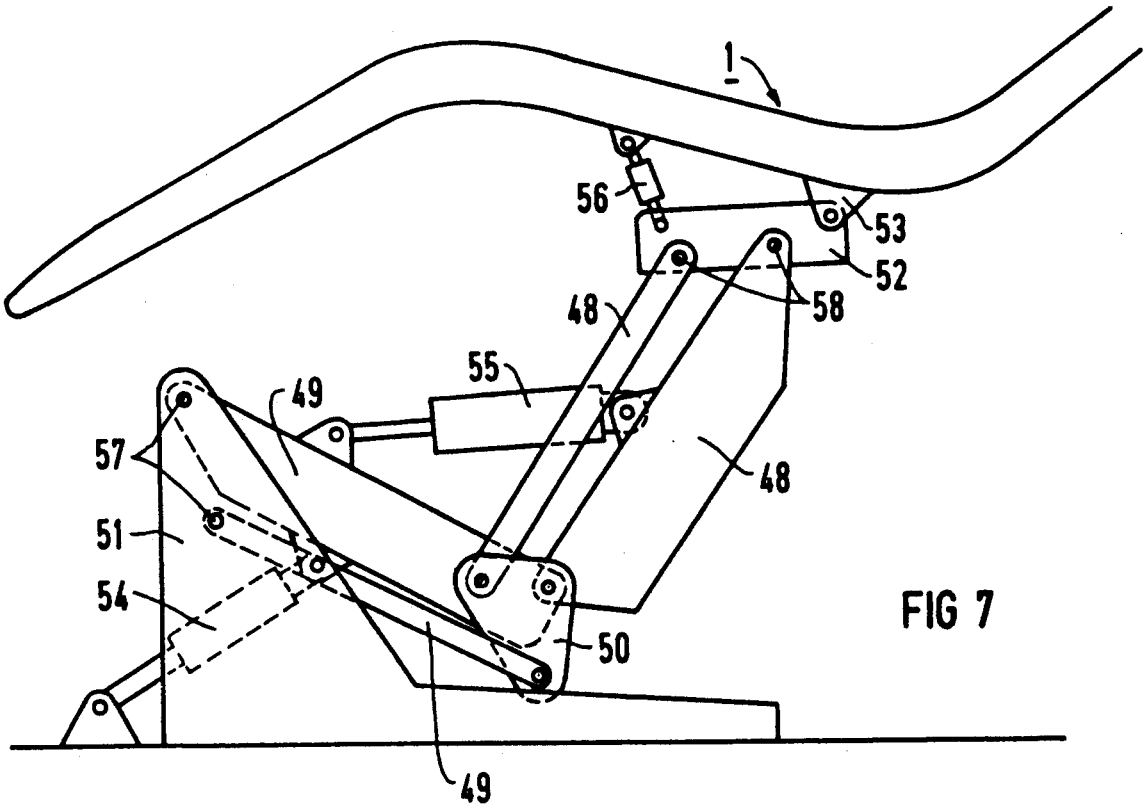
FIG. 7 is a side view of a third modification of an adjustment mechanism for the upper chair in accordance with the present invention.

In the employment of hydraulic lifting cylinders, as illustrated in the embodiment of FIG. 7, the lifting cylinders would be driven by a control unit 20 utilizing electro-magnetic valves.

Figure 3:
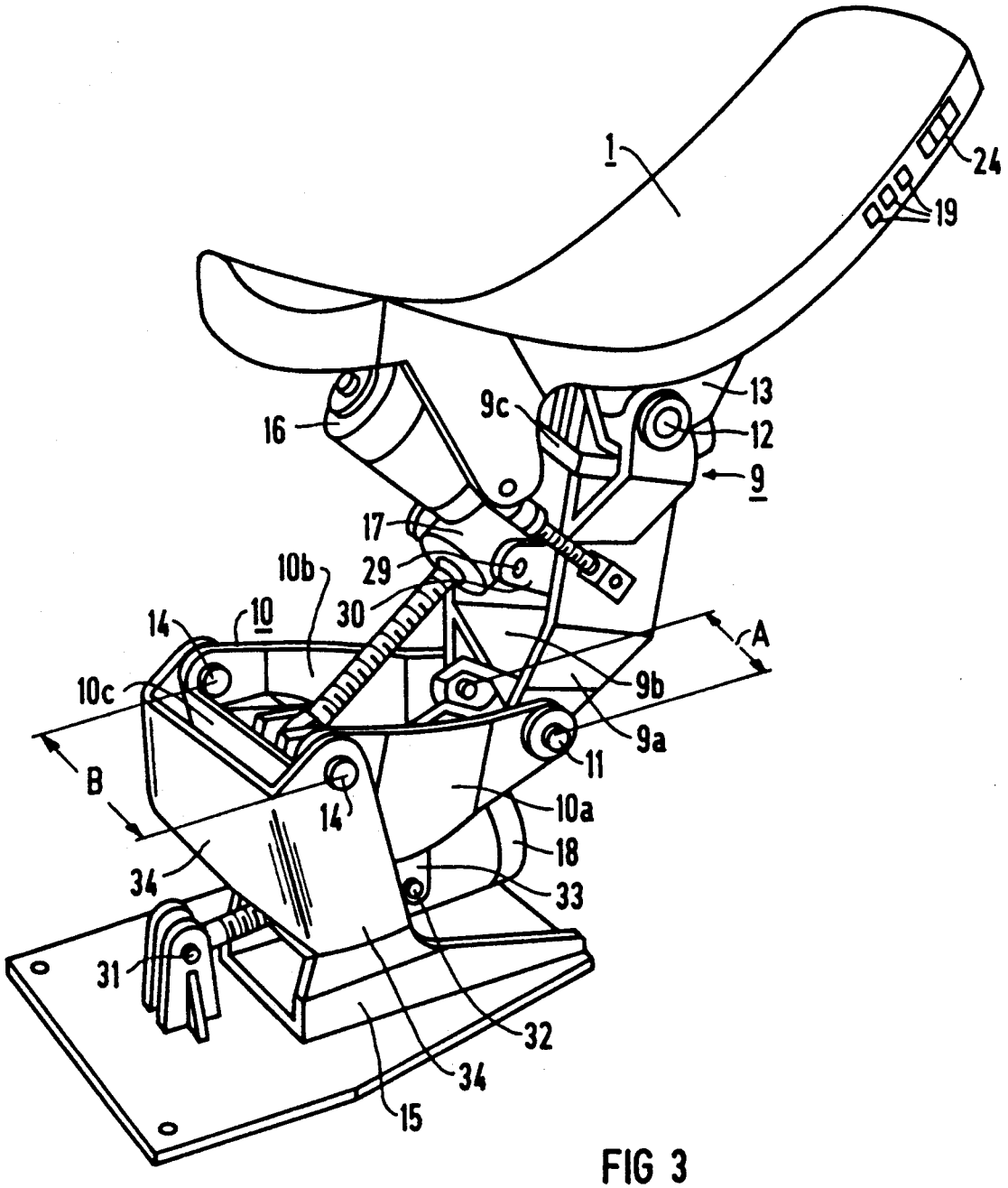
FIG. 3 is a perspective view of the structure of the adjustable mechanism for the upper chair part in accordance with the present invention.

FIG. 3 shows the patient chair of FIG. 1 in a raised position and also shows that the two articulated arms 9 and 10 are each a substantially U-shaped part. For example, the arm 9 has lateral cheeks 9*a* and 9*b* interconnecting by a cross-connecting stay 9*c* and the arm 10 has cheeks 10*a* and 10*b* which are spaced apart and interconnected by a cross-connecting stay 10*c*. As illustrated, the lateral cheeks 10*a* and 10*b* do not proceed parallel to one another but are at a smaller distance apart along the axis of the point 11 than they are along the axis forming the point 14. A spacing A of the articulation at point 11 is, thus, smaller than the spacing B of the articulation 14. A similar case can also occur for the articulated arm 9, whose lateral cheeks 9*a* and 9*b* lie inside those of the articulated arm 10. This change to a smaller spacing in the region of the articulation 11 achieves a constriction that creates additional space in this region for the accommodation of other component parts. For example, the free space acquired in this way can be used for the accommodation of transverses for holding an apparatus used by the physician or the assistant.

It has proven especially advantageous when, as shown, the base part 15 comprises a support pedestal 34 that is arranged such that the articulation 14, to which the one end of the articulated arm 10 is hinged, are arranged adjacent to the foot end of the chair, namely at a height C, as illustrated in FIG. 1. This height C approximately corresponds to the length D of the articulated arm 10. This height expediently amounts to about 300 mm above the standing plane 5. The two articulated arms 9 and 10 are expediently constructed of identical length, however, this is not an absolute necessity.

Figure 4:
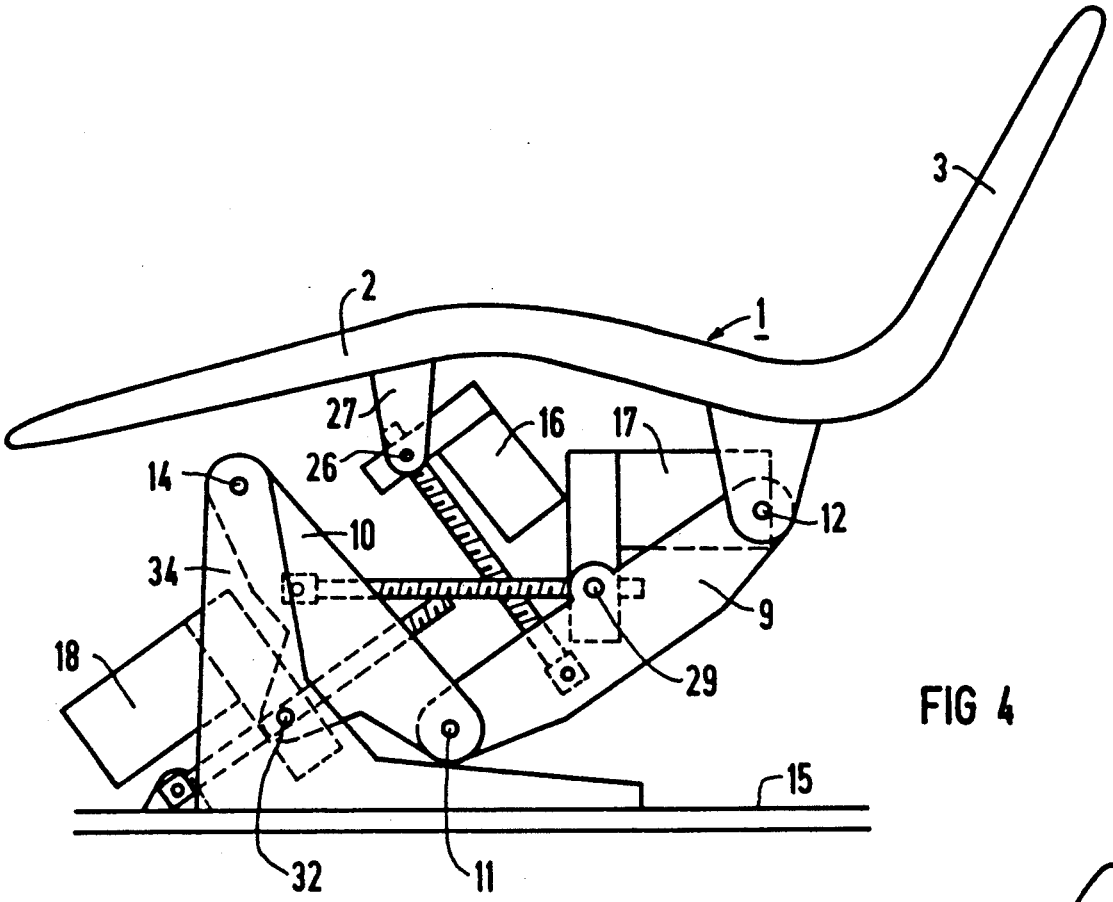
FIG. 4 is a side view similar to FIG. 1 of a modification of the embodiment of FIG. 1.

Spindle drives, wherein the spindle is retracted into and extends out of a spindle drive part, are employed in the embodiments shown up to now. In a modification shown in FIG. 4 that corresponds to the embodiment of FIGS. 1 and 3 with respect to the structure of the pedestal and of the articulated arms, the drive parts comprise spur gears flanged or keyed to a motor shaft and these spur gears drive the spindles. Worm gearings or, respectively, toothed belt gearings can also be employed instead of the spur gear arrangement. As already stated about the embodiment of FIG. 1 with respect to the arrangement of the adjustment drive applies, i.e., the points of articulation of the adjustment drives can be selected different from that which is shown for the structure or for other reasons. It is, likewise, conceivable to provide the hinging or gearing and spindle reversed, as shown.

Figure 5:
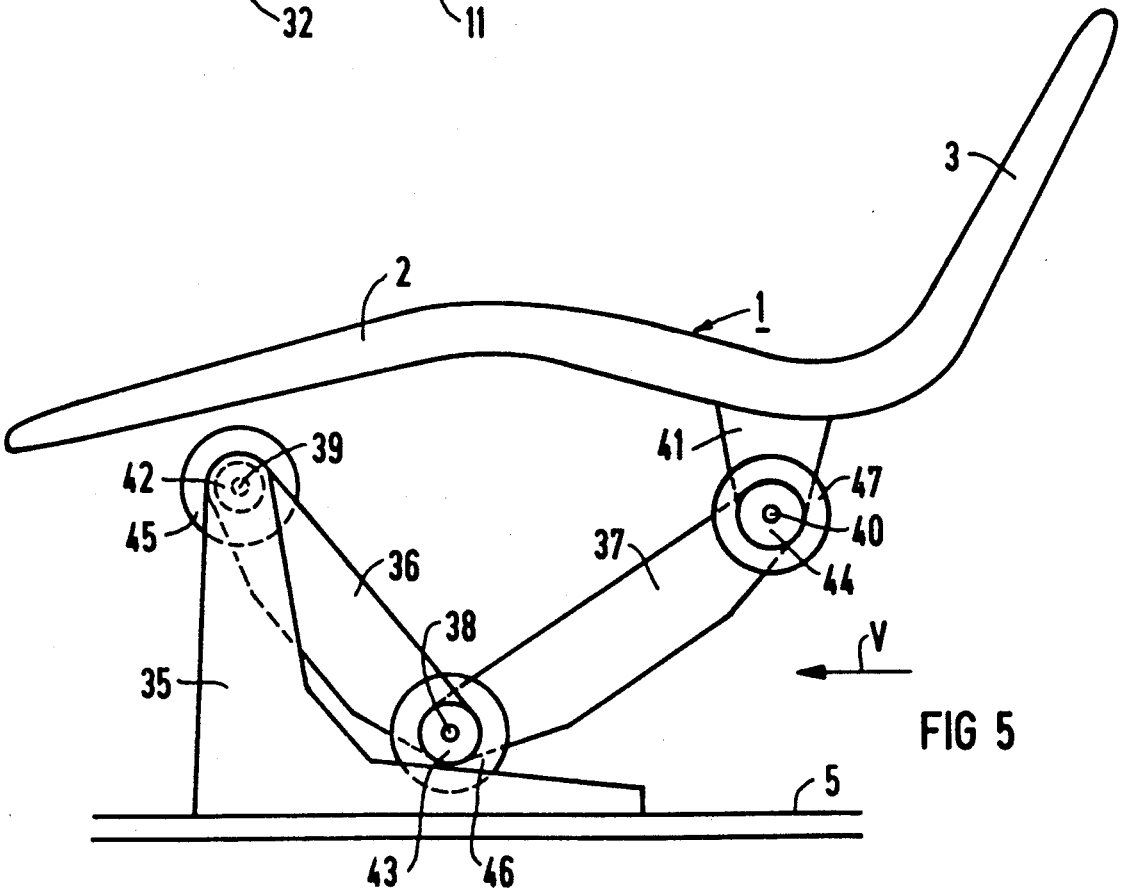
FIG. 5 is a side view of a second modification of the device of FIG. 1.
Figure 6:
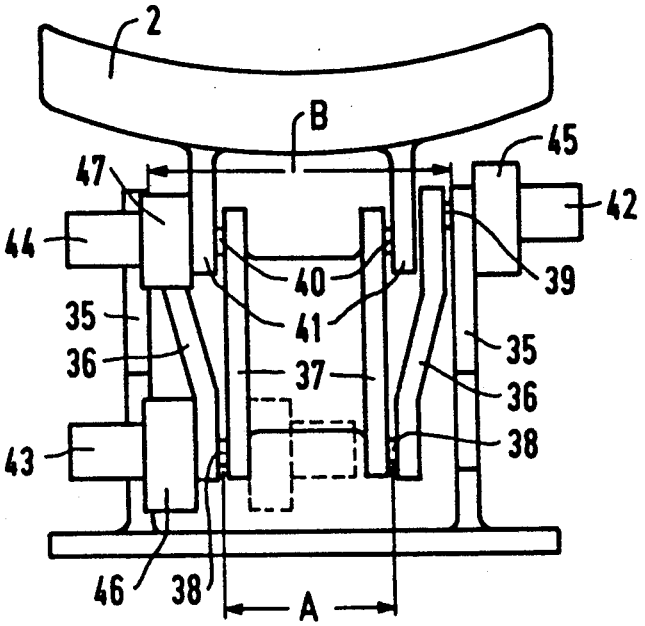
FIG. 6 is an end view taken in the direction of arrow V of FIG. 5.

The exemplary embodiment of FIGS. 5 and 6 differs from the embodiment set forth up to now in that the spindle drives are replaced by electric motors or hydraulic motors, respectively, having highly exaggerated step-down gears, for example planetary gears. These gear drives are coaxially arranged at the point of articulation of the articulated arms and, thus, directly drive them. In this embodiment, two articulated arms, such as 36 and 37, are movable independent of one another and are present at a support pedestal 35 that corresponds to the pedestal 34 of FIG. 1. The one end of the articulated arm 36 and 37 are connected to one another on an articulated or pivot axis 38 and the other end of the arm 36 is connected to the pedestal 35 on an articulation or pivot axis 39 and another end of the arm 37 is connected to a carrier or pedestal 41 of the upper chair part on an articulation or pivot axis 40. Adjustable drives having adjustment motors 42, 43 and 44 are provided at all three points 38, 39 and 40 of articulation. Low-voltage DC motors that, as shown simplified in FIG. 2, are driven independently of one another are preferably utilized as the adjustment motors. The reduction of the motor speed to the "effective speed" of the part to be adjusted, articulation arm and seat frame, or, respectively, articulation arm and pedestal, occurs with the assistance of suitable gear components that are references 45, 46 and 47 in FIGS. 5 and 6. For example, such gears can be a planetary gear. In the illustrated embodiment, the torque transmission occurs in that the gear components 45 are torsionally connected to the chair pedestal 35 and the drive shaft of the motor 42 is connected to the arm 36 on the articulated axis 39. The gear component 46 is connected to the articulated arm 36 and the drive shaft of the corresponding motor 43 is connected to the arm 37 on the axis 38 and the component 47 is connected to the bracket or carrier 41 as the drive shaft of the motor 44 is connected to the arm 37 at the axis 40.

As shown in broken lines in FIG. 6, the arrangement of the drive unit, motor and gearing, can be provided both inside as well as outside of the articulated arms. The arrangement of the drive unit inside the articulated arms has the advantage that the power take-off can occur on both sides and this yields an improved torsional rigidity of the articulated arms.

In the embodiment that has been presented, the height adjustment of the seat will largely occur by pivoting the articulated arm 36 around the axis formed by the axel 39 and the longitudinal adjustment will be predominately occurred by pivoting the second arm 37 around the axel 38. Given an exact height adjustment or longitudinal displacement, however, a combination of both motions will occur, and this is determined by the control means or unit 20 of FIG. 2 according to the position of the position sensors.

The different articulation spacings A and B between the lateral cheeks of the articulated arms may be very clearly seen in FIG. 6. The construction at the common point articulation 11 in FIG. 3 and at the axis 38 in FIG. 5 has already been mentioned, but is clearly visible in FIG. 6.

In an embodiment of the invention which is in contrast to the above-mentioned embodiments does not use electrical motors for the adjustment but, however, guarantees an exact motion sequence as the embodiments set forth hereinabove. In this embodiment of FIG. 7, the articulated arms are composed of parallelogram linkage having two parallel arms. For example, one of the parallelogram linkages has parallel arms 48, 48, which are pivotably connected to a member 50 and to a member 52 with the pivotal connections to the member 52 having parallel extending axes 58. The second or other parallelogram linkage has two parallel arms 49, 49 which are pivotably connected to a common member 50 and have their other ends pivotably connected to a pedestal 51 by pivotable connections 57. The member 52 is pivotably connected to a bracket 53 of the upper chair part 1. A second end of the member 52 is connected to the chair part by a hydraulic adjustment drive 56. A drive 54 extends between the base of the pedestal 51 and the parallel arms 49, while a drive 55 extends between the parallel arms 48 and 49. These drives are all illustrated as being hydraulic piston-and-cylinder arrangements, however, other electromotive devices could be utilized.

When utilizing hydraulic adjustment, the electronic controls can be replaced. However, the linear motion sequence is, then, not as optimum as in the embodiment set forth hereinabove.

Since the mechanical structure of the chair has now been set forth with various modifications, the particular motion sequence of the upper chair part and the control of the adjustment drives is set forth in greater detail hereinbelow with respect to the following Figures.

Figure 8:
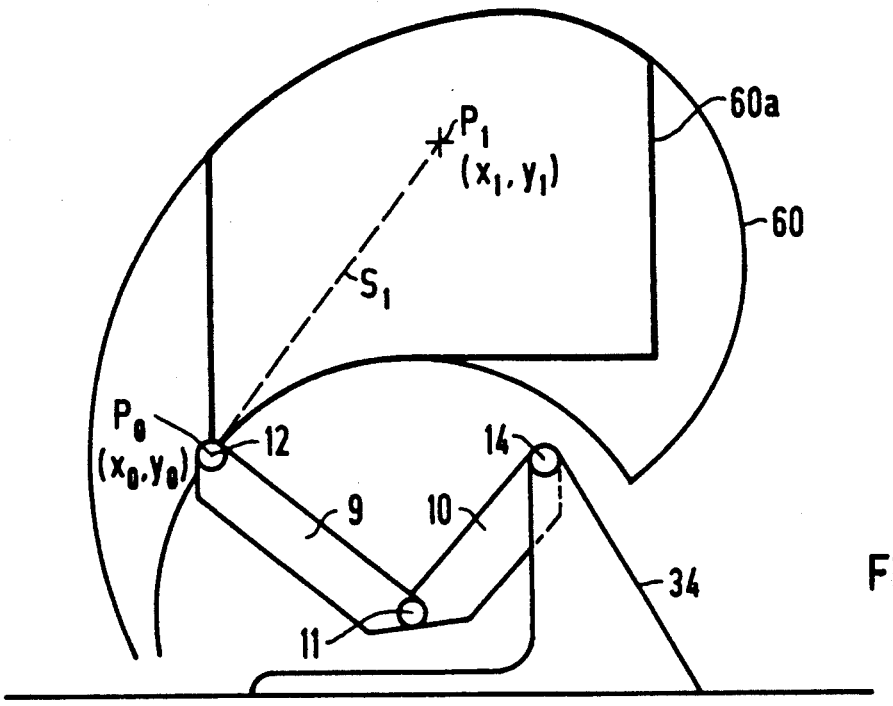
FIG. 8 is a schematic view illustrating a range of adjustment obtainable with the adjustment mechanism in accordance with the present invention.

FIG. 8 shows the motion possibilities that the substructure of the mechanism of the chair will provide. The curve 60 shows an envelope within which a movement of the upper chair part is possible on the basis of the double-articulated arm structure that has been set forth hereinabove. For simplification, this envelope 60 is shown for the point 12 of the axis of articulation. The curve **60*a*, shown with a heavy line inside the envelope 60, represents the range of adjustment which is employed in practice. It is assumed in the following consideration that the point 12 or articulation standing for another, arbitrary point of the upper chair part is to be brought from an initial position $P_0$ having the coordinates $x_0$, $y_0$ into a position $P_1$ having the coordinates $x_1$, $y_1$. For example, the position $P_1$ is represented by a pre-programmed position $P_1$ that can be called in with one of the program keys 19**, for example the $P_1$ key. In order to bring the upper chair part from the reference point $P_0$ to the point $P_1$, the upper chair part would have to execute a motion both in the upward direction as well as in the forward direction toward the foot end.

The control unit or means 20, as illustrated in FIG. 10, contain a central processor 61 which is a CPU to which, via serial interface 63, the switches 21–23 for a manual adjustment of the upper chair part are connected and, also, the program selection keys 19 for automatic adjustment of the upper chair part into one of three freely selectable chair positions $P_1$–$P_3$ are connected. In addition, the sensors G1–G3 are connected to the CPU 61 through respective A/D converters 64 and the adjustment motors M1, M2 and M3 are also connected to the CPU 61 through A/D converters 65 and servo units 66 that contain a power output stage for the motor comprising the control circuit. A work program for the central processor 61 is provided in a "read-only" memory 67 and the programs $P_1$–$P_3$ are stored in a "read/write" memory 68.

If the chair is in the position $P_0$ of FIG. 8, the electronic interrogation of the control unit 20 finds out what actual values the sensors G1–G3 have. Using this information, the processor 61 then calculates the coordinates $x_0$ and $y_0$ of $P_0$. Subsequently, the microprocessor calculates the shortest distance $S_1$ between the starting point $P_0$ and the selected point $P_1$, which has the coordinates $x_1$ and $y_1$.

Figure 9:
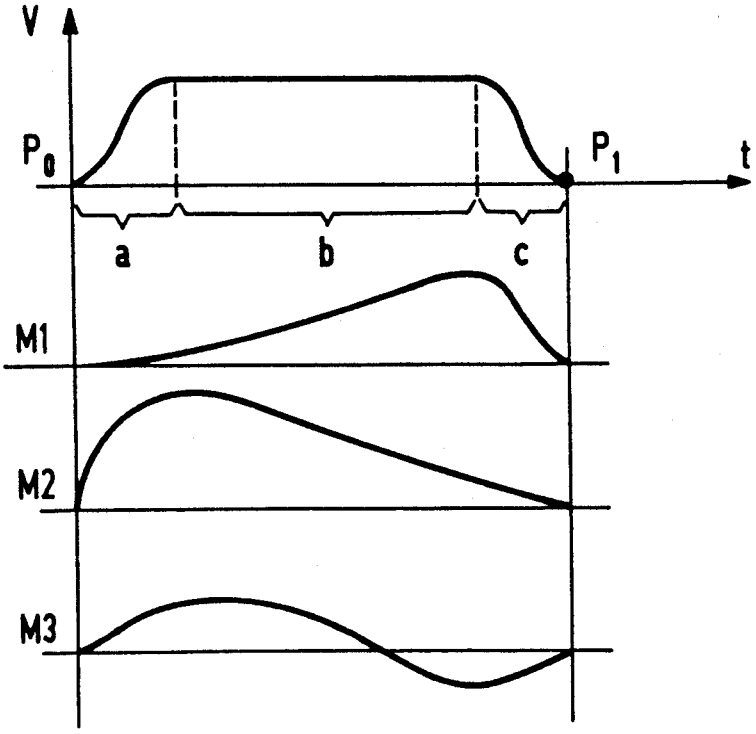
FIG. 9 is a compound speed of movement (velocity) versus time for moving the chair from a point $P_0$ to a point $P_1$ and also illustrates the various velocity versus time curves for each of the three adjustment mechanisms.

The motion of the upper chair part when it is adjusted from the starting point $P_0$ to the selected position $P_1$ should not occur continuously, but according to a defined execution curve having, for example, a linear rise at the beginning of the motion and having a linear drop toward the end of the motion. Advantageously, the motion transitions are gentle as a result of what is referred to as a ramp curve, as shown in the top of FIG. 9. In accordance with such a ramp curve, which has three periods a, b and c, a gentle increase in the rate of speed is established in a defined, first time span a followed by a uniform speed, which is established during a defined, second time span b, then followed by a gentle decay of the speed, which is established during a third time span c that will end as the selected position $P_1$ is reached. Given such a sequence curve, it is necessary that the individual adjustment motors M1, M2 and M3 have different speed behaviors over the particular running time t. Such a speed behavior is shown for the three motors M1, M2 and M3 in the V/t diagrams of FIG. 9 under the illustrated sequence curve. In order to obtain a relatively gentle start for the adjustment motion of the upper chair part at the beginning of the motion corresponding to the sections a of the sequence curve of FIG. 9, it will be necessary, for example, to keep the speed of the adjustment motor M1 extremely low in this time span, whereas the adjustment motor M2 is immediately started with a relatively high speed or velocity. It can be, likewise, advantageous in the run-out phase (the zone c) that the adjustment motor M3 runs with a negative speed or, for example, in the opposite rotational sense.

With reference to the prescribed sequence curve, the computer or the central processor 31 calculates the individual V/t diagrams for the individual motors M1–M3. The voltages required for achieving the velocity values corresponding to the prescribed curves are supplied in the adjustment motor M1–M3 by power output stages 66. In order to obtain an optimally exact observation of the sequence curve, the control circuits are preferably provided that monitor the curve values and control them as warranted in that the values of the sensors G1–G3 are constantly interrogated and compared to a rated value.

Although various minor modifications may be suggested by those versed in the art, it should be understood that we wish to embody within the scope of the patent granted hereon all such modifications as reasonably and properly come within the scope of our contribution to the art.

We claim:

1. In a dental patient chair having a seat with a backrest and position means for adjusting a seat height, an inclined position of the seat and backrest, as well as the position of the seat and backrest with reference to a longitudinal direction of the chair to a base on a standing plane, the improvements comprising said position means including two articulated arms pivotably connected to one another to form a first pivot, a first of said two arms having a free end connected to a pedestal at a point above the standing plane to form a second pivot, said second of said two articulated arms having a free end pivotably connected to a member connected to said seat to form a third pivot, separately controllable adjustment drive means being provided for adjusting the articulated arms and control means for actuating the adjustment drive means for the purpose of changing the chair position, said adjustment drive means having a first adjustment drive means for adjusting the first articulated arm with regard to the second articulated arm, a second adjustment drive means for adjusting the first articulated arm with regard to the pedestal and a third adjustment drive means for adjusting the seat with regard to the second arm.

2. In a dental patient chair according to claim 1, wherein the two articulated arms are arranged with the second pivot between the pedestal and the free end of the first arm being situated closer to a foot end of the seat than the first pivot of the pivotable connection between said pair of arms.

3. In a dental patient chair according to claim 1, wherein a vertical distance of the pivotable connection of the pedestal to the first articulate arm is approximately equal to the length of said first arm.

4. In a dental patient chair according to claim 3, wherein each of the first and second articulated arms have a U-shape with two lateral cheeks connected by a cross-connecting element and at least the first articulated arm has a constriction adjacent a common pivotable connection with the second arm so that the spacing between the lateral cheeks at the common pivotable connection is smaller than the spacing between said cheeks at the connection to said pedestal.

5. In a dental patient chair according to claim 1, wherein each of the two articulated arms is composed of a parallelogram linkage.

6. In a dental patient chair according to claim 6, wherein each of said adjustment drive means is a piston and cylinder.

7. In a dental patient chair according to claim 1, wherein each of the drive means is an electromotive means.

8. In a dental patient chair according to claim 7, wherein the first adjustment drive means being arranged at the point of the first pivot, the second adjustment drive means being arranged at the point of the second pivot, and the third adjustment drive means being arranged at the point of the third pivot.

9. In a dental patient chair according to claim 7, wherein each of the electromotive drives comprises a spindle drive motor having a flanged on reduction gear.

10. In a dental patient chair according to claim 1, wherein the control means includes a central processor, position sensors for measuring the position of selected parts of the chair and supplying the information to the central processor, said control means having program selection key for pre-selected positions of the chair providing the coordinates for each of the pre-selected positions to the control means, said processor calculating the distance between a starting position determined from said position sensors to the pre-selected position and subsequently operating the adjustment drive means in accordance with a predetermined sequence curve.

11. In a dental patient chair according to claim 10, wherein the sequence curve contains a rising function having a linear acceleration at the beginning of the motion a subsequent uniform motion and towards the end of the motion contains a deaccelerating function with a linear retardation.

12. In a dental patient chair according to claim 11, wherein the sequence curve is defined in a fashion of a ramp having a gentle increasing function at the beginning of the adjustment motion and a gentle descending function at the end of the adjustment motion.

13. In a dental patient chair according to claim 1, wherein each of the articulated arms has a U-shape formed by two lateral cheeks spaced at a distance from one another and joined to one another by a cross-connecting element, at least said first arm having a constriction toward the common point of connection to the second arm with a spacing between the lateral cheeks less than the spacing of the lateral cheeks at the pivotable connection to said pedestal.

14. In a dental patient chair according to claim 1, wherein the two articulated arms are composed of parallelogram linkage.

* * * * *